United States Patent [19]

Ham

[11] Patent Number: 4,885,507

[45] Date of Patent: Dec. 5, 1989

[54] ELECTRONIC STARTER COMBINED WITH THE L-C BALLAST OF A FLUORESCENT LAMP

[76] Inventor: Byung I. Ham, 1524 King Ham Way, Fullerton, Calif. 92633

[21] Appl. No.: 279,328

[22] Filed: Dec. 2, 1988

Related U.S. Application Data

[63] Continuation of Ser. No. 76,314, Jul. 21, 1987.

[51] Int. Cl.[4] ..... H05B 37/00

[52] U.S. Cl. ..... 315/244; 315/242; 315/DIG. 5; 315/241 R; 315/224

[58] Field of Search ..... 315/244, 243, 240, 241, 315/246, 103, 106, 245, 242, 227 R, 274, 224, 225, DIG. 5, DIG. 2, 290, 209 R

[56] References Cited

U.S. PATENT DOCUMENTS

| | | | |
|---|---|---|---|
| Re. 31,146 | 2/1983 | Gyursanszky | 315/106 |
| 4,229,681 | 10/1980 | Plumb | 315/244 |
| 4,348,615 | 9/1982 | Garrison et al. | 315/244 |
| 4,398,126 | 8/1983 | Zuchtriegel | 315/244 |
| 4,398,128 | 8/1983 | Wollank | 315/244 |
| 4,406,976 | 9/1983 | Wisbey et al. | 315/244 |
| 4,473,778 | 9/1984 | Adachi | 315/101 |
| 4,547,706 | 10/1985 | Krummel | 315/244 |
| 4,553,070 | 11/1985 | Sairanen et al. | 315/244 |
| 4,644,228 | 2/1987 | Nillssen | 315/244 |
| 4,695,771 | 9/1987 | Hallay | 315/244 |
| 4,701,673 | 10/1987 | Lagree et al. | 315/244 |

*Primary Examiner*—Leo H. Boudreau
*Assistant Examiner*—Michael Razavi
*Attorney, Agent, or Firm*—Blakely, Sokoloff, Taylor & Zafman

[57] ABSTRACT

A low voltage electronic starter for an L-C Ballast of a fluorescent lamp is provided having a switching circuit having a resistive-capacitive network, a diac and triac, a transformer and a voltage multiplying rectifier.

1 Claim, 2 Drawing Sheets

ELECTRONIC STARTER COMBINED WITH THE L-C BALLAST OF A FLUORESCENT LAMP

This is a continuation of application Ser. No. 076,314 filed July 21, 1987.

FIELD OF THE INVENTION

The present invention relates to an electronic starter for a fluorescent lamp with L-C ballast. More specifically, the present invention relates to an electronic starter which has a low power consumption, is light in weight, small in size, and which can rapidly light a fluorescent lamp.

Glow start lamps take a long period of time to light yet operate at relatively low voltage.

BACKGROUND OF THE INVENTION

A fluorescent lamp is generally classified as a glow start lamp, an instant lamp, or a rapid start lamp.

Glow start lamps provide poor visibility, however, during the long period of time required to light the lamp and also because the light flickers for an extended period.

Recently, a prior art rapid start lamp was developed in order to overcome the above stated disadvantages. However, this prior art rapid start lamp requires a comparatively high voltage in order to turn it on (i.e. three to four times the voltage of the glow start lamp).

Therefore, the volume and weight of the ballast for the rapid start lamp is increased because the capacity of the ballast corresponds to its volume.

When high voltage is supplied to the rapid start lamp during turn on, oxide material such as barium which coats the electrodes at each end of a fluorescent tube is removed by the high temperature caused by the high voltage, such that both ends of the fluorescent lamp become black and non-conductive.

Therefore, the operational life of the fluorescent lamp decreases drastically in such rapid start lamps. Additionally, noise created by a high frequency component of the high voltage can cause an error in an adjacent computer which is sensitive to the influence of the surrounding situation.

SUMMARY OF THE INVENTION

In order to overcome the obstacles and drawbacks of the prior art, it is an objective of the present invention to provide an electronic starter which momentarily applied a preheat current to the electrodes at each end of a fluorescent lamp by means of a rapid start circuit comprising triac, diac, capacitors, as well as other elements.

It is a further object of the present invention to provide an electronic starter for a fluorescent lamp which is turned on by means of a counter electromotive force induced by a transformer, thereby reducing the ballast capacity of the present invention by one-fourth that of the prior art rapid start lamp.

Another objective of the present invention is to provide an electronic starter which can be effectively utilized adjacent sensitive computer equipment without interfering with the operation thereof.

The fluorescent lamp, according to the present invention, can be turned on by a low counter electromotive force in comparison with the rapid start circuit of the prior art, which is in need of a high counter electromotive force.

The above stated objectives are achieved in an electronic starter for use with an L-C Ballast of a fluorescent lamp comprising a switching circuit having a triac and a silicon controlled rectifier, the switching circuit further comprising power input, a choke coil, a first capacitor, a first filament terminal being coupled to the choke coil and the first capacitor, a secondary coil being coupled to the first filament terminal and a second terminal of the fluorescent lamp through the switching circuit, a resonance circuit, the resonance circuit being coupled to the second filament and the power-input, the resonance circuit comprising a primary coil of a transformer and capacitor, a voltage multiplying rectifier circuit comprising a resistance and a diode, first and second terminals of the resonance circuit being coupled to the voltage multiplying rectifier circuit.

DETAILED DESCRIPTION OF THE INVENTION

Figure 1:
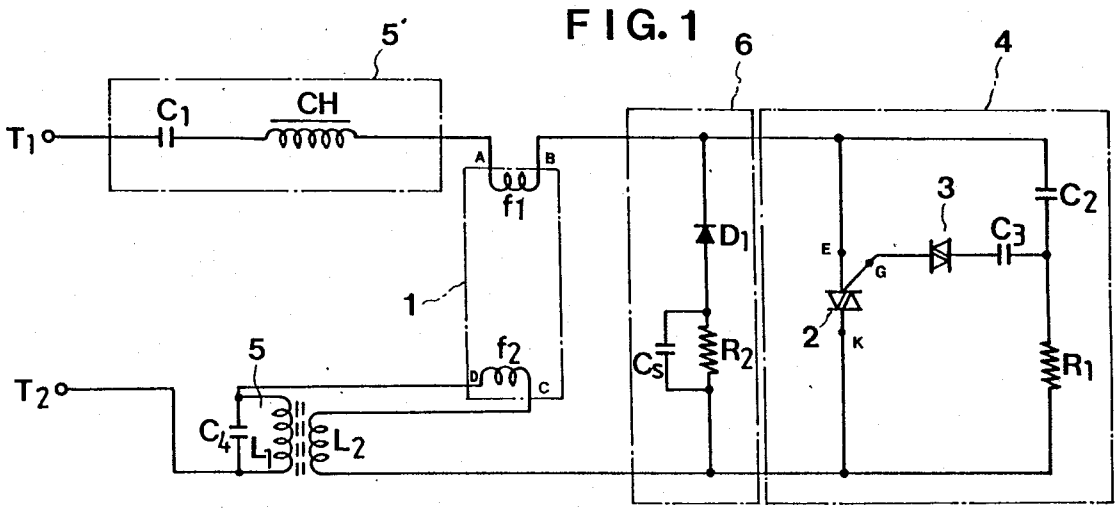
FIG. 1 is an electronic starter circuit according to the invention.

Referring to FIG. 1, there is shown an embodiment of the electronic starter circuit of a fluorescent lamp embodying the present invention.

The electronic starter circuit of the present invention includes:

a resonance circuit 5,5' comprising capacitors C1, C4 and coil CH; a switching circuit 4 consisting of a triac 2, a diac 3, a resistor R1, and capacitor C2,C3; and a voltage multiplying rectifier 6 consisting of a diode D1 and a resistance R2, which is coupled to the two terminals of the switching circuit.

A resonance circuit comprised of a capacitor C1 and a coil CH minimizes impedance to an A.C voltage by virtue of its connection between input terminal T1 and filament point "A".

The switching circuit, which is connected to the filament point "B," is configured so that diac 4 and capacitor C3 are connected between the gate of triac 2 and capacitor C2, and that capacitors C2, C3 are connected to the main electrode K of triac 2, through resistor R1.

The diac 3 triggers triac 2 according to the time constant of capacitor C2 and resistor R1.

More specifically with respect to the operation of the switching circuit AC 110/220, voltage applied to the power-input T1 is supplied through filament F1 of the fluorescent lamp and to a first resonance circuit (consisting of capacitor C1 and choke coil CH) to the main electrode E of triac 2 and capacitor C2.

The AC voltage, which is applied to the power-input T1, is supplied via a second resonance circuit consisting of capacitor C4 and the primary of the power transformer PT filament F2, of the lamp, and the secondary power transformer, to the main electrode of triac 2 and capacitors C2, C3.

Since the operating signal is not supplied to the gate of the triac 2, it remains shut off until the diac triggers it on, as described below.

Figure 2:
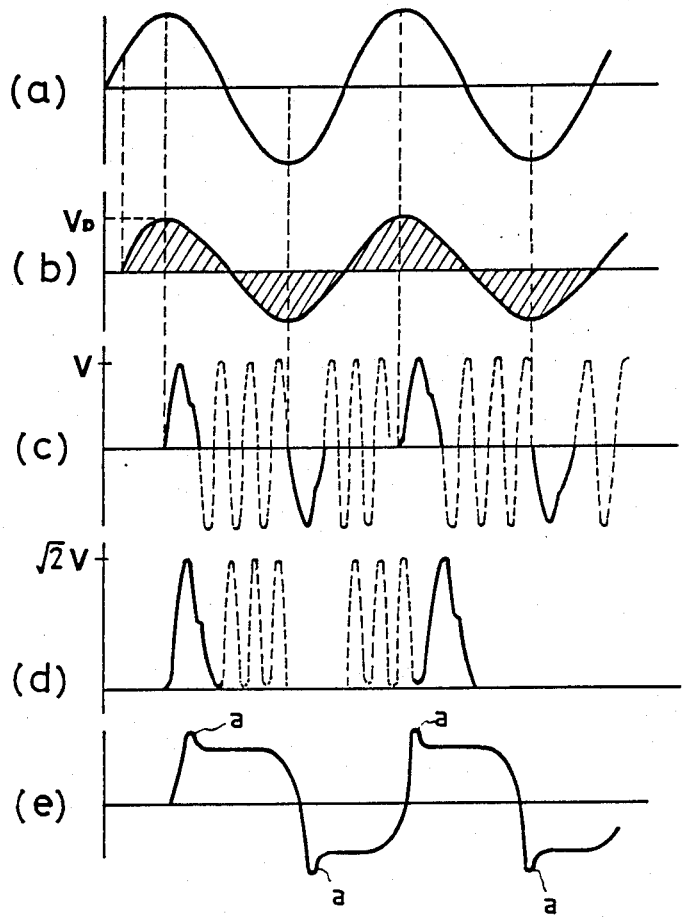
FIG. 2 is the wave graph showing the operating wave forms of FIG. 1.
Figure 3:
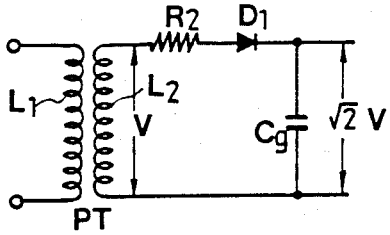
FIG. 3 is an equivalent voltage multiplying rectifier according to the invention.

The capacitors C2 and C3 continue to charge and discharge, thereby forming the voltage wave shown in FIG. 2(b), which illustrates the delay wave of FIG. 2(a).

When the capacitor C2 is discharging, a discharging current accelerates the charge of the capacitor C3 which charges until the voltage developed at capacitor C3 exceeds the breakover voltage of diac 3, thereby actuating the diac 3.

Capacitor C3 of the switching circuit 4 also prevents undesired actuation of the switching circuit in the following way. When the triac 2 is turned on by a trigger signal from diac 3, surge voltage, i.e. a counter electromotive force, is generated and applied to a secondary coil L2 of transformer PT. The filaments f1 and f2 of fluorescent lamp 1 thereby start being pre-heated and release the therm-ion in the tube of fluorescent lamp 1. Since the primary coil L1 of the transformer PT generates a high voltage proportional to its turn ratio by the counter electromotive force which is applied to the secondary coil L2 of the transformer, the fluorescent lamp 1 becomes lighted. At this time, in the event that the fluorescent lamp 1 is not lighted, the secondary voltage is supplied to the fluorescent lamp 1 so as to ensure lighting of the same. The secondary voltage is shown in FIG. 2(c) and is induced by the second resonance circuit which is comprised of primary coil L1 and capacitor C4.

When the voltage induced by transformer PT is lower than the lighting voltage level of the fluorescent lamp 1, that is, the lamp has a low temperature, high percentage of humidity, or the fluorescent lamp 1 is near the end of its life, a high induced voltage is needed in order to light the fluorescent lamp 1. The voltage multiplying rectifier 6, comprised of diode D1 and resistor R2 coupled to switching circuit 4, is provided.

More precisely, since the fluorescent lamp 1 operates as a capacitor Cg before lighting, it makes a voltage multiplying rectifier with diode D1 and resistor R2. When the surge voltage V induced from transformer PT is supplied to this voltage multiplying rectifier, the diode D1 turns on and maximum voltage $\sqrt{2}$ V [shown in FIG. 2(*d*)]is supplied to both ends of the fluorescent lamp, thereby ensuring lighting of the fluorescent lamp 1 even under the afore-described less than optimum conditions.

After the fluorescent lamp 1 is lighted, the voltage between the electrodes of the fluorescent lamp 1 drops to a negative voltage (i.e. −10v) which is a common characteristic of an arc lamp. This low voltage is lower than the breakdown voltage of triac 2 so that the switching circuit 1 is turned off. At this time, capacitor C2 discharges into diac 3, however, capacitor C3, which is coupled to diac 3, ensures that the switching circuit 1 is not inadvertently turned on.

To the resistor R2, included in the voltage multiplying rectifier 6, the capacitor Cs is connected in series, so that the capacitor Cs repeats a charge and discharge whenever a discharging current of an alternating wave flows, after the fluorescent lamp 1 is lighted.

When the capacitor Cs is discharging, the surge voltage (a) as in FIG. 2(e), is generated, so that the fluorescent lamp can maintain lighting by surge voltage(a), even though only a few therm-ion arcs are produced in poor conditions such as during a change of temperature or humidity.

As above mentioned, the lighting device according to the invention prevents the flickering and noise which are attendant problems of prior art lamps. The present invention may be manufactured at a low cost because it requires a few relatively inexpensive components and also operates at a high efficiency because the prior glow starter or pre-heating device for the filament is not needed.

I claim:

1. An electronic starter for use with an L-C ballast of a fluorescent lamp including a switching circuit having a triac, a diac and a capacitor, said switching circuit being connected in parallel with said fluorescent lamp, wherein said capacitor is for preventing undesired actuation of the switching circuit between said diac and said capacitor, said starter further comprising: a resonance circuit having a choke coil and a first capacitor, said resonance circuit being connected in series with a first terminal of said fluorescent lamp; a voltage multiplying rectifier circuit having a resistance and a diode and a capacitor connected in parallel with said resistance, said voltage multiplying rectifier circuit being connected in parallel with said fluorescent lamp and being connected in parallel with said switching circuit through a transformer, said transformer being connected to a second terminal of said fluorescent lamp.

* * * * *